US007409939B2

(12) United States Patent
Hughes et al.

(10) Patent No.: US 7,409,939 B2
(45) Date of Patent: Aug. 12, 2008

(54) CYLINDER HEAD HAVING AN INTEGRALLY CAST ROCKER SHAFT PEDESTAL

(75) Inventors: Frank G. Hughes, Lincolnshire (GB); Kathleen Bernadette Queenan, London (GB); Richard Jackson, Attleborough (GB)

(73) Assignee: Perkins Engines Company Limited, Peterborough (GB)

( * ) Notice: Subject to any disclaimer, the term of this patent is extended or adjusted under 35 U.S.C. 154(b) by 65 days.

(21) Appl. No.: 10/662,822

(22) Filed: Sep. 16, 2003

(65) Prior Publication Data

US 2004/0129240 A1 Jul. 8, 2004

Related U.S. Application Data

(60) Provisional application No. 60/411,018, filed on Sep. 16, 2002.

(51) Int. Cl.
*F01L 1/18* (2006.01)

(52) U.S. Cl. ..... 123/90.39; 123/90.44; 123/193.5; 74/559

(58) Field of Classification Search ..... 123/90.39, 123/90.41, 90.44, 90.27, 90.31, 193.3, 193.5, 123/90.16, 90.2, 90.6; 29/888.2; 74/559, 74/567, 569, 560

See application file for complete search history.

(56) References Cited

U.S. PATENT DOCUMENTS 3,964,455 A * 6/1976 Brown ..... 123/90.43
4,505,236 A * 3/1985 Nakamura ..... 123/90.27
4,628,875 A 12/1986 Wells et al.
4,655,177 A * 4/1987 Wells et al. ..... 123/90.36
4,856,467 A * 8/1989 Kronich ..... 123/90.43
4,882,977 A 11/1989 Himeno et al.
5,131,357 A 7/1992 Inoue et al.
5,617,818 A 4/1997 Lüders
5,636,600 A * 6/1997 Sweetland et al. ..... 123/90.4
5,954,159 A 9/1999 Nakamura
6,178,937 B1 1/2001 Solomon et al.
6,484,683 B2 * 11/2002 Zielke ..... 123/193.5
6,755,172 B2 * 6/2004 Neubock et al. ..... 123/193.5

* cited by examiner

*Primary Examiner*—Ching Chang
(74) *Attorney, Agent, or Firm*—Finnegan, Henderson, Farabow, Garrett & Dunner

(57) ABSTRACT

Use of rocker shaft pedestals that are manufactured separately from the cylinder head and subsequently fixed to the cylinder head increases manufacturing and assembly costs of an internal combustion engine. The disclosed cylinder head obviates these problems by providing a cylinder head for an internal combustion engine that comprises a top deck and at least one integrally cast rocker shaft pedestal. A rocker shaft for use with a cylinder head of the invention includes at least one flat formed on an underside of the shaft that is adapted for mating with a top of a rocker shaft pedestal. Also described is an internal combustion engine comprising a cylinder block, a cylinder head having a top deck and at least one integrally cast rocker shaft pedestal, and a rocker shaft mounted on the at least one rocker shaft pedestal, the rocker shaft having a plurality of rocker arms mounted thereon. The rocker shaft includes at least one flat formed on an underside thereof adapted for mating with a top of the at least one rocker shaft pedestal. Also described is a method for manufacturing a cylinder head assembly including an integrally cast rocker shaft pedestal.

12 Claims, 6 Drawing Sheets

CYLINDER HEAD HAVING AN INTEGRALLY CAST ROCKER SHAFT PEDESTAL

CROSS REFERENCE TO RELATED APPLICATIONS

This application claims the benefit of commonly owned provisional application No. 60/411,018 filed on Sep. 16, 2002.

TECHNICAL FIELD

The invention relates to a cylinder head for an internal combustion engine. In particular the invention relates to a cylinder head of the type having a top deck and at least one rocker shaft pedestal for supporting a rocker shaft.

BACKGROUND

U.S. Pat. No. 4,628,875 describes a cylinder head and a rocker shaft mounting assembly. The assembly comprises four pedestal mounts, each of which is fixed to the head by means of two bolts that engage bores machined in the cylinder head. A separate cap is associated with each pedestal mount. The cap and mount are machined such that when they are bolted together they form a bore that embraces the rocker shaft and fixes the rocker shaft to the cylinder head. This arrangement requires the use of a relatively large number of components, which results in increased production and assembly costs.

SUMMARY OF THE INVENTION

According to one aspect of the invention, there is provided a cylinder head for an internal combustion engine, the cylinder head comprising a top deck and at least one integrally cast rocker shaft pedestal.

The invention also relates to a rocker shaft for use with a cylinder head of the invention, the rocker shaft including at least one flat formed on an underside of the shaft that is adapted for mating with a top of a rocker shaft pedestal.

The invention also relates to an internal combustion engine comprising a cylinder block, a cylinder head having a top deck and at least one integrally cast rocker shaft pedestal, and a rocker shaft mounted on the at least one rocker shaft pedestal. The rocker shaft has a plurality of rocker arms mounted thereon and includes at least one flat formed on an underside of the shaft adapted for mating with a top of the at least one rocker shaft pedestal.

The invention also relates to a method of manufacturing a cylinder head assembly comprising the steps of providing a cylinder head having at least one integrally cast rocker shaft pedestal and fixing a rocker shaft assembly on the at least one integrally cast rocker shaft pedestal, the rocker shaft assembly including a rocker shaft and at least one rocker arm.

Other aspects and features of the invention will be apparent from the following description and the accompanying drawings.

DETAILED DESCRIPTION

Figure 1:
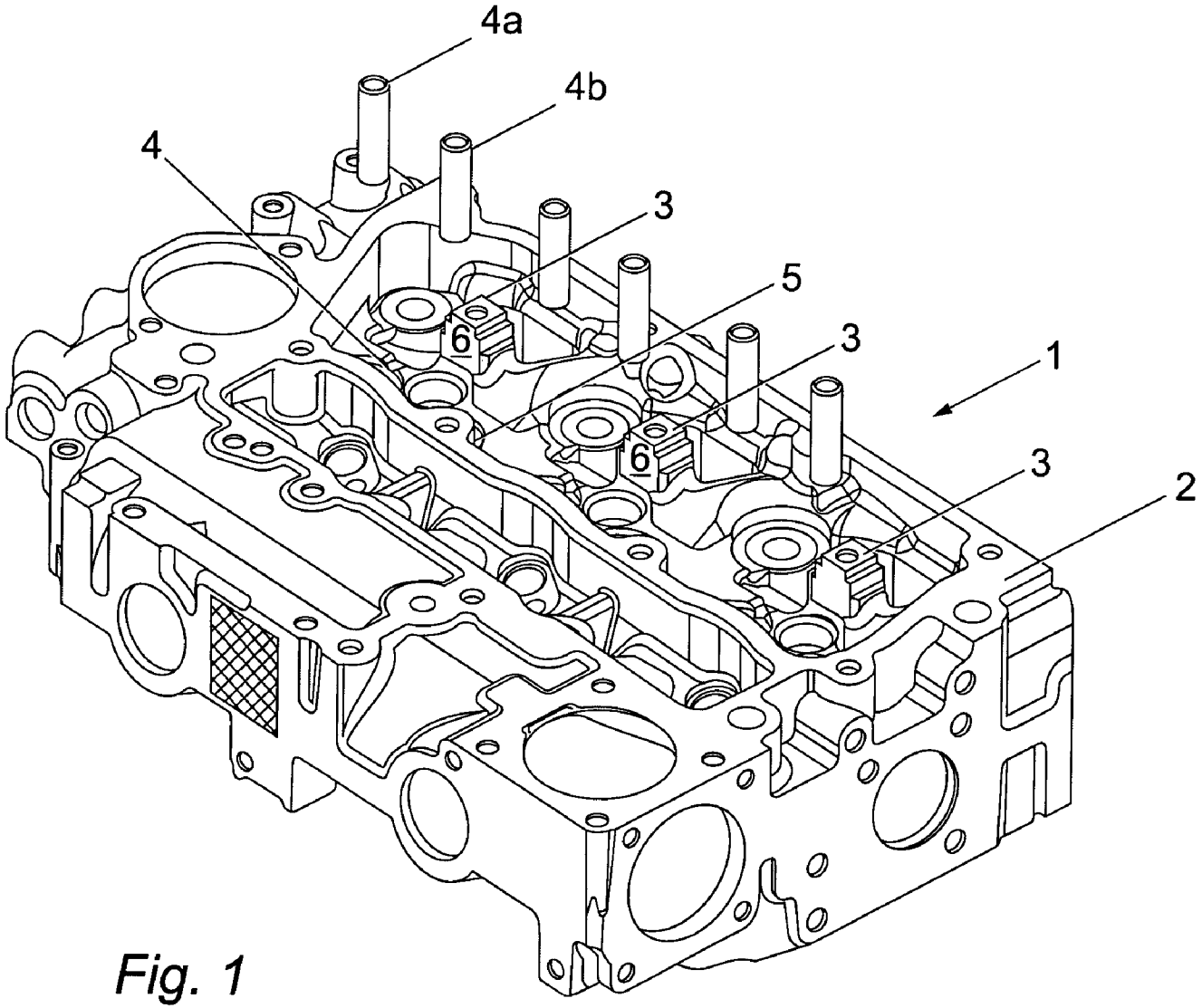
FIG. 1 is a perspective, partially exploded, view of a cylinder head according to one embodiment of the invention.
Figure 2:
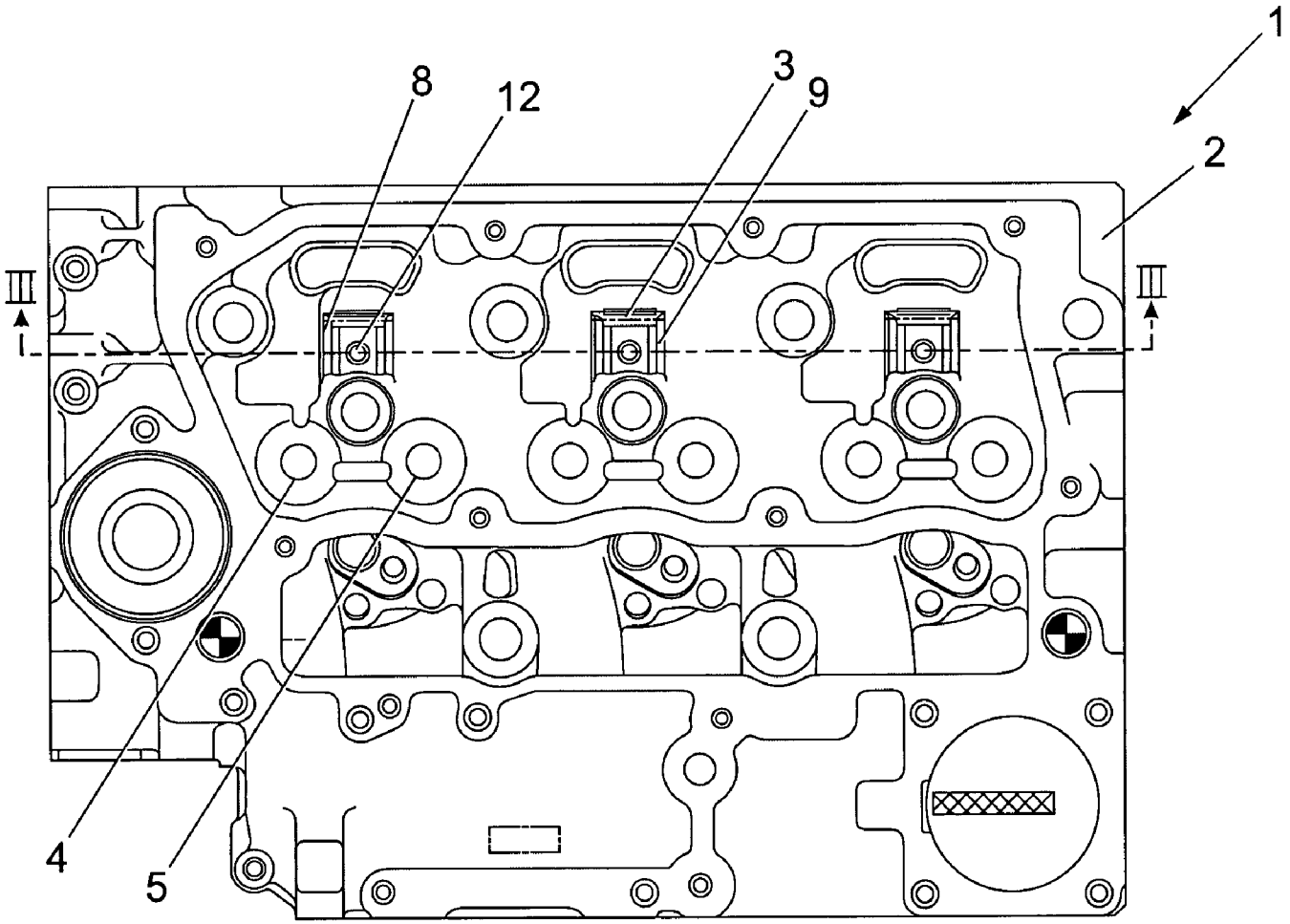
FIG. 2 is a plan view from above the cylinder head of FIG. 1.
Figure 3:
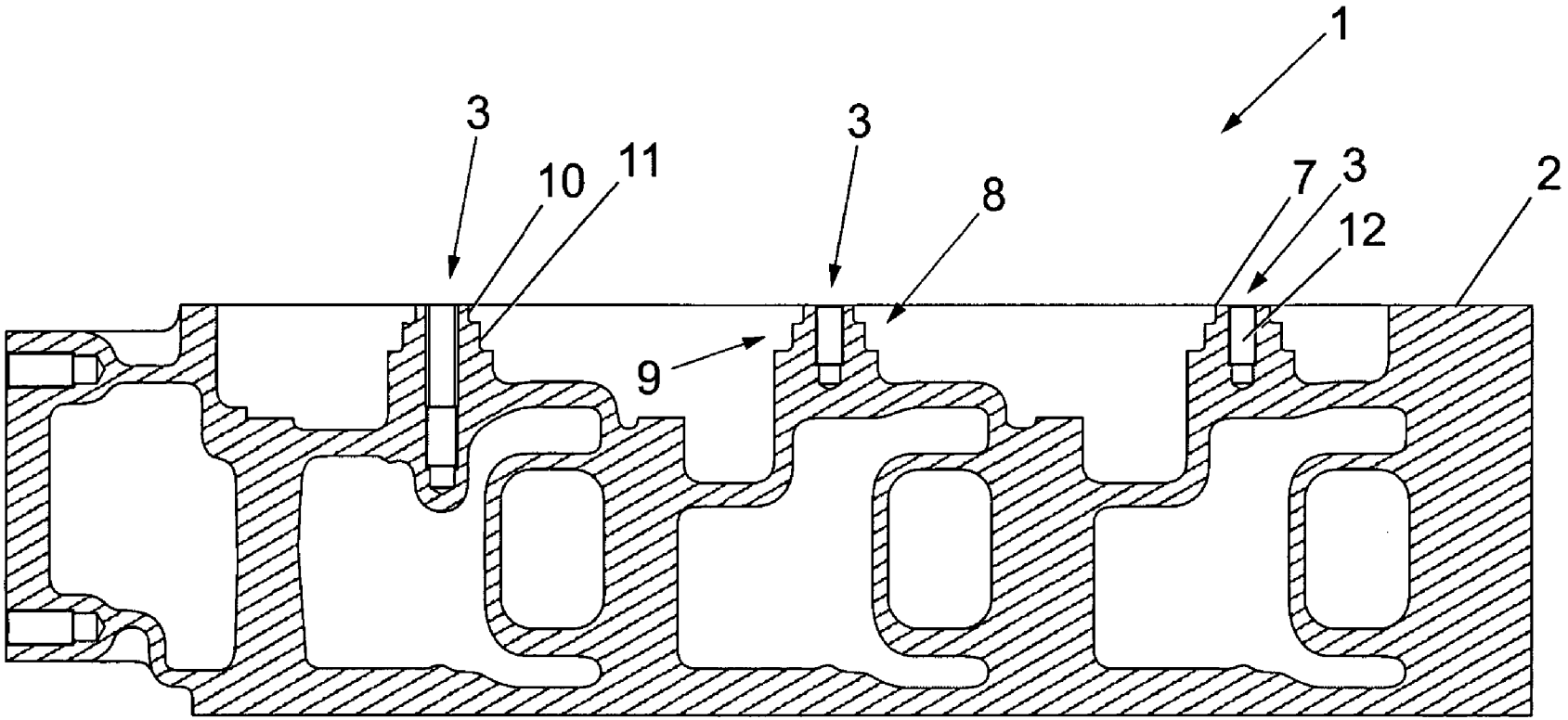
FIG. 3 is a section view taken along the lines III-III of FIG. 2.

Referring to the drawings, and initially to FIGS. 1 to 3, there is illustrated a cylinder head 1 for an internal combustion engine (not shown). In this case, the engine is a three cylinder in-line diesel engine, however it should be appreciated that the invention is also applicable to engines having any number of cylinders. The cylinder head 1 includes a top deck 2 and three rocker shaft pedestals 3, each of which is integrally cast with the cylinder head 1. A pair of valve guide bores are formed in the head 1 adjacent each pedestal 3, the pair consisting of an exhaust valve guide bore 4 and an inlet valve guide bore 5. Valve guide sleeves 4*a*, 4*b* (shown in exploded view in FIG. 1) are inserted into the valve guide bores 4, 5.

Each rocker arm pedestal 3 includes a front wall 6, a rear wall (not shown), a top surface 7, and a pair of opposed sidewalls 8 and 9, respectively. In this embodiment, a pair of steps are formed in each sidewall 8, 9, namely a spacing step 10 and an adjacent lower step 11. It will be appreciated that the pedestals may be formed without the steps as is described in more detail below. The top surface 7 of each pedestal 3 is machined in a same plane as the top deck 2, as is best illustrated in FIG. 3. Each rocker arm pedestal 3 also includes a bore 12 for receiving a fastener that fixes a rocker shaft (see below) to the pedestals.

Figure 5:
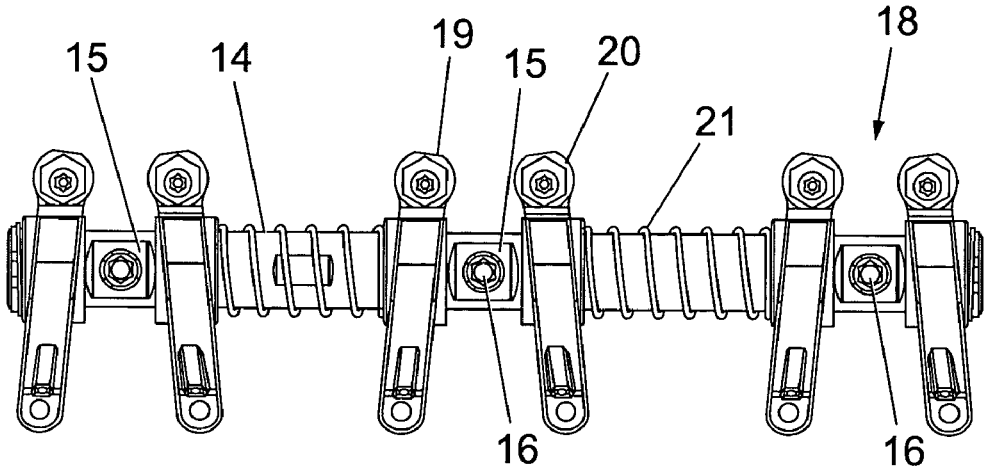
FIG. 5 is a plan view from above the rocker shaft assembly of FIG. 4.
Figure 4:
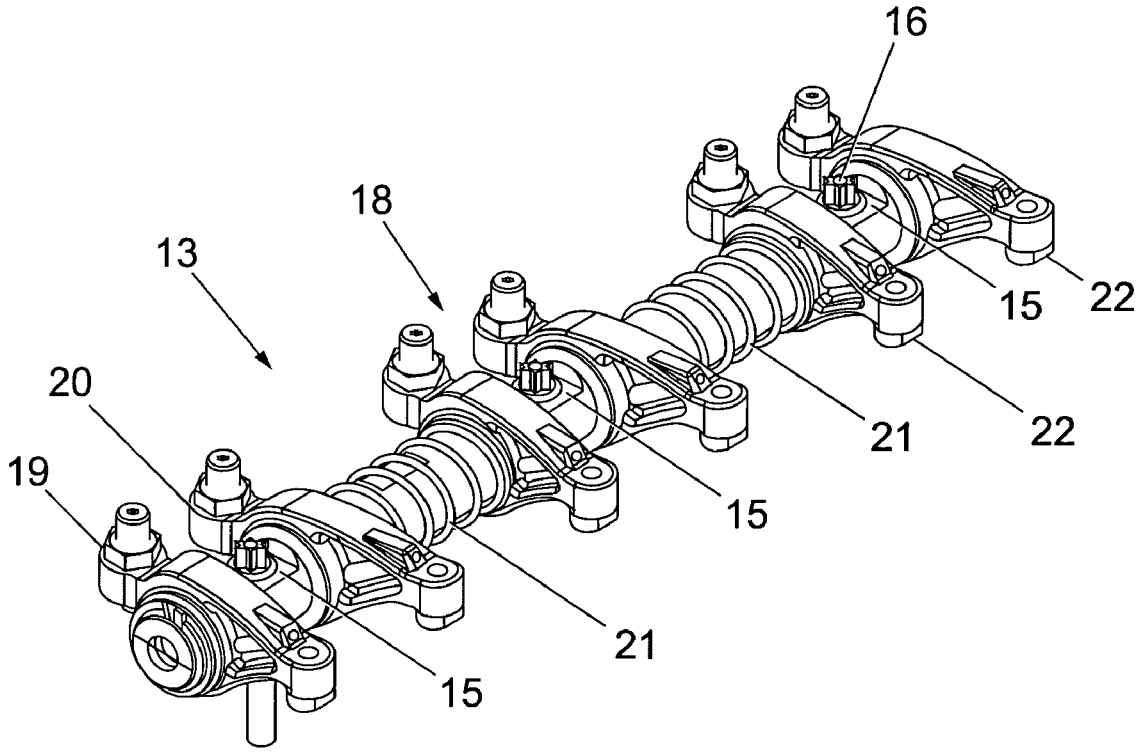
FIG. 4 is a perspective view of a rocker shaft according to the invention for use with the cylinder head of FIG. 1.

Referring to FIGS. 4 and 5, there is illustrated a rocker shaft assembly 13 for use with the cylinder head of FIGS. 1 to 3, and comprising a rocker shaft 14 having three flats (see FIG. 6) formed on an underside thereof. The flats are dimensioned, and spaced along the shaft 14, to allow them to mate with the pedestals 3 formed in the cylinder head 1. The shaft 14 also includes three flats 15 formed on an upperside thereof, directly above the flats on the underside. A bore (not shown) is formed in the shaft 14 at each upper flat that, in use, receives a bolt 16 that fixes the rocker shaft 14 to the pedestals 3. The shaft 14 includes three pairs of rocker arms 18 pivotally mounted to the shaft 14. Each pair of rocker arms 18 consists of an inlet rocker arm 19 and an exhaust rocker arm 20, which are pivotally mounted to the shaft 14 on each side of each pair of flats. A pair of helical springs 21 embrace the shaft 14 and bear against the arms 19, 20. A first end of the inlet rocker arm 19 is coupled to an inlet valve (not shown) and a first end of the exhaust rocker arm 20 is coupled to an exhaust valve (not shown). A second end of each rocker arm 19, 20 carries a cam follower 22.

Figure 6:
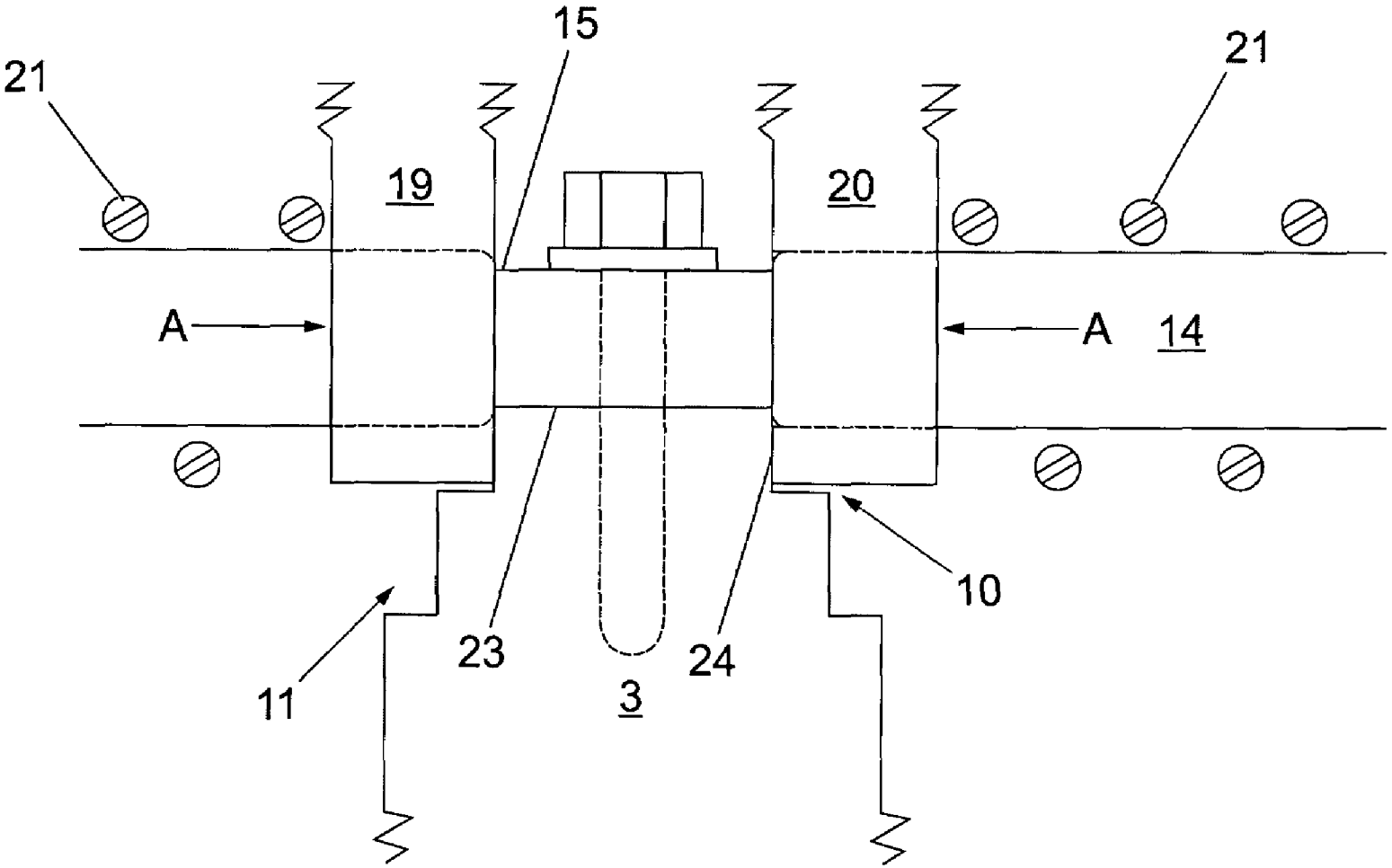
FIG. 6 is a schematic illustration of the engagement between the rocker shaft of the invention and the cylinder head of FIG. 1.

Referring to FIG. 6, there is illustrated a rocker shaft 14 bolted to a pedestal 3 formed on the cylinder head 1 of FIGS. 1 to 3. A flat 23 on the underside of the shaft 14 mates with the top surface 7 of the pedestal 3. Helical springs 21 bear against the rocker arms 19, 20 biasing them in the direction of the arrow A and into contact with a vertical flat 24 of each spacing step 10, which has the effect of correctly spacing the rocker arms 19, 20 over the valve guide bores (not shown). The lower steps 11 are provided to allow the rocker arms 19, 20 complete their rocking motion.

Figure 7:
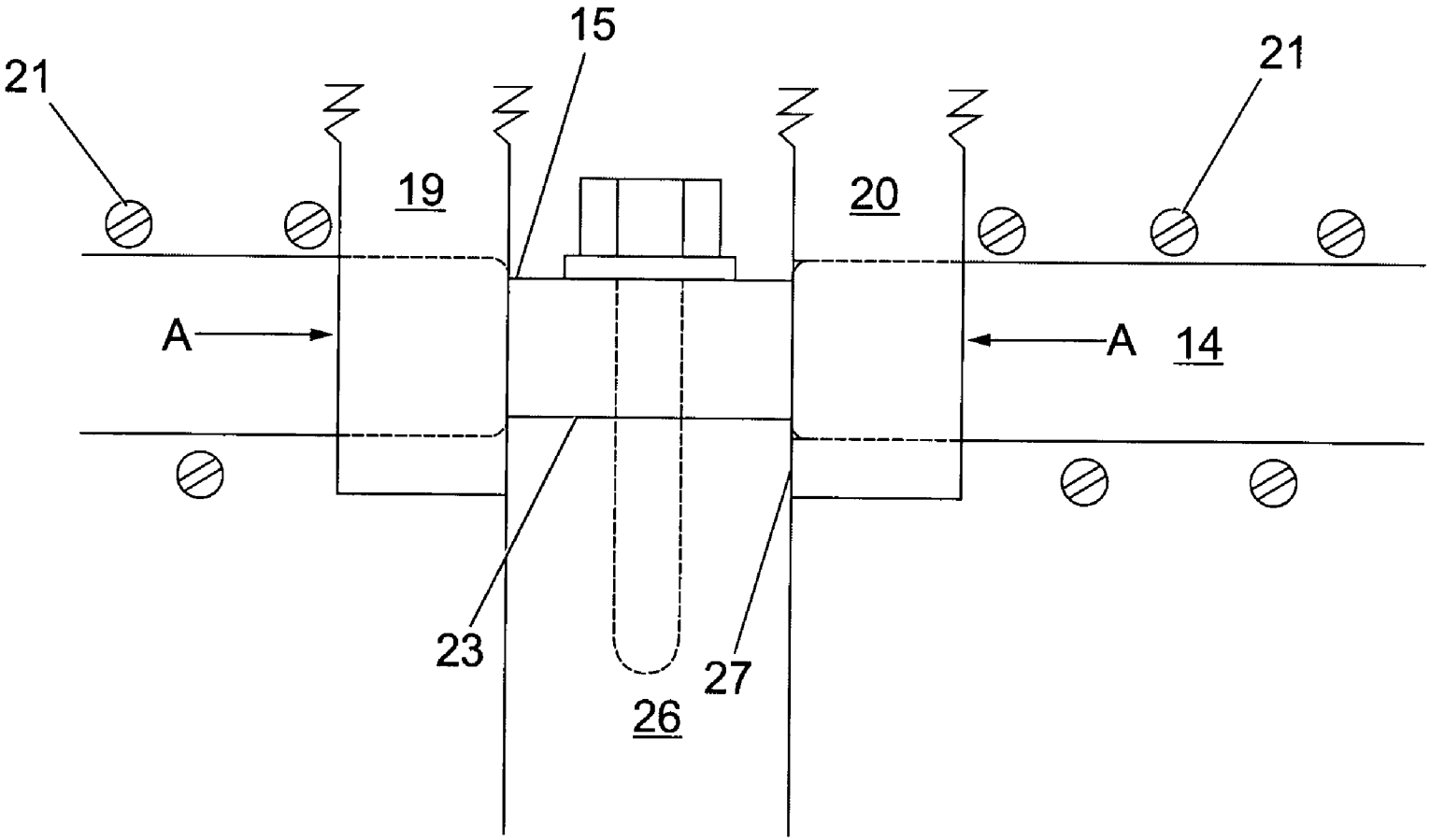
FIG. 7 is a schematic illustration of the engagement between the rocker shaft of the invention and a cylinder head according to an alternative embodiment of the invention.

Referring to FIG. 7, there is illustrated part of a cylinder head 25 according to an alternative embodiment of the invention in which parts described with reference to the previous embodiment are assigned the same reference numerals. In this embodiment, an integrally cast rocker shaft pedestal 26 is formed without any steps wherein the rocker arms 19, 20 are biased by the helical springs 21 into contact with the sidewalls 27 of the pedestal 26. Thus, the sidewalls 27 of the pedestal 26 have the effect of correctly spacing the rocker arms 19, 20 over the valve guide bores (not shown).

During manufacture of the cylinder head 1 according to the invention, the cylinder head 1 is cast with three integrally cast rocker shaft pedestals 3. The rocker shaft assembly 13, which includes the rocker shaft 14 and three pairs of rocker arms 18, is fixed to the three pedestals 3. The pairs of rocker arms 18 are correctly spaced along the rocker shaft 14 prior to the rocker shaft 14 being fixed to the pedestals 3. Generally, the correct spacing is ensured by means of a jig that may form an integral part of the rocker shaft assembly packaging material, which jig and packaging material are only removed after the rocker shaft assembly 13 has been placed onto the pedestals 3.

It will be appreciated that while the embodiments of the cylinder head described above include a number of pedestals equal to the number of cylinders, cylinder heads having a number of pedestals that is more or less than the number of cylinders are also envisaged as being within the scope of this invention.

It will be further appreciated that while the rocker shaft assembly of the invention as described above includes a pair of rocker arms per cylinder, rocker shaft assemblies having three or more rocker arms per cylinder are also envisaged. An example of when three rocker arms may be utilized is when the engine includes a mechanically actuated electronic unit fuel injector.

INDUSTRIAL APPLICABILITY

The cylinder head 1 of the invention is mounted to a top of an engine block and includes pairs of valve bores 4, 5, each of which communicate with a cylinder of the engine. The cylinder head 1 includes a number of integrally cast pedestals 3 that support a rocker shaft 14 mounted above the head 1. Flats 23 are formed on an underside of the rocker shaft 14 that mates with top surface 7 of the pedestals 3. A number of rocker arms 19, 20 are mounted to the rocker shaft 14 for pivotal movement across the shaft 14 as well as axial movement along the shaft 14.

The use of integrally cast rocker arm pedestals 3 decreases the number of components required for assembly of an engine. Thus, for example, a four cylinder engine having a cylinder head according to the invention will require at least eight less components than a conventional four cylinder engine that employs separate pedestal mounts and caps. This has the effect of considerably reducing the cost of the manufacture, and assembly, of the engine.

The spacing steps 10, 11 on the pedestals 3 are dimensioned to correctly position the rocker arms 19, 20 over the valve guide bores 4, 5. Thus, in use, the helical springs 21 on the rocker shaft 14 bias the rocker arms 19, 20 into contact with vertical flats 24. The lower steps 11 on the pedestals 3 provide clearance for the rocker arms 19, 20 to complete their rocking motion. Alternatively, the sidewalls 27 of the pedestal 26 function to space the rocker arms 19, 20 over the valve guide bores 4, 5.

During manufacture of the cylinder head assembly, the rocker shaft pedestals are integrally cast with the cylinder head. During assembly, the rocker arms are correctly spaced along the rocker shaft by means of a positioning jig. Thus, the rocker shaft assembly is placed on the rocker shaft pedestals with the positioning jig in place thereby ensuring that the rocker arms carried on the rocker shaft are correctly positioned on each side of the pedestals. Once thus positioned, the jig is removed and the rocker shaft is fixed to the pedestals.

Although preferred embodiments have been described here in, improvements and modifications may be made without departing from the scope of the following claims.

What is claimed is:

1. An internal combustion engine, comprising:

a cylinder head including a top deck and a first rocker shaft pedestal, the first rocker shaft pedestal including a substantially flat top surface; and a rocker shaft mounted on the top flat surface of the first rocker shaft pedestal; and first and second rocker arms mounted on the rocker shaft, wherein the first rocker shaft pedestal is disposed between the first and second rocker arms that are mounted on the rocker shaft without another rocker shaft pedestal disposed between the first and second rocker arms, and the first rocker shaft pedestal includes opposed first and second outer side walls having substantially flat portions that abut side surfaces of the first and second rocker arms, respectively, to position the first and second rocker arms.

2. The internal combustion engine of claim 1, wherein the first and second outer side walls each include a spacing step adjacent the top flat surface of the first rocker shaft pedestal.

3. The internal combustion engine of claim 2, wherein the first and second outer side walls each include a second step formed beneath the spacing step.

4. The internal combustion engine of claim 1, wherein the first rocker shaft pedestal is integrally cast in the cylinder head.

5. The internal combustion engine of claim 1, wherein the top deck of the cylinder head is in a same plane as the top flat surface of the first rocker shaft pedestal.

6. The internal combustion engine of claim 1, wherein the top deck of the cylinder head is in a substantially same plane as the top flat surface of the first rocker shaft pedestal.

7. The internal combustion engine of claim 6, wherein the first and second outer side walls each include a spacing step adjacent the top flat surface of the first rocker shaft pedestal.

8. The internal combustion engine of claim 7, wherein the first and second outer side walls each include a second step formed beneath the spacing step.

9. The internal combustion engine of claim 1, wherein the cylinder head includes a second rocker shaft pedestal having a substantially flat top surface, the rocker shaft is mounted on the top surface of the second rocker shaft pedestal, and third and fourth rocker arms are mounted on the rocker shaft such that the second rocker shaft pedestal is disposed between the third and fourth rocker arms without any other rocker shaft pedestal being disposed between the third and fourth rocker arms.

10. The internal combustion engine of claim 9, wherein the cylinder head includes opposed third and fourth outer side walls having substantially flat portions that abut side surfaces of the third and fourth rocker arms, respectively, to position the third and fourth rocker arms.

11. The internal combustion engine of claim 10, wherein the rocker shaft includes first and second flats, the first flat mating with the top flat surface of the first rocker shaft pedestal and the second flat mating with the top flat surface of the second rocker shaft pedestal.

12. The internal combustion engine of claim 1, wherein the rocker shaft includes a flat mating with the top flat surface of the first rocker shaft pedestal.

* * * * *

UNITED STATES PATENT AND TRADEMARK OFFICE

CERTIFICATE OF CORRECTION

PATENT NO. : 7,409,939 B2
APPLICATION NO. : 10/662822
DATED : August 12, 2008
INVENTOR(S) : Frank Hughes It is certified that error appears in the above-identified patent and that said Letters Patent is hereby corrected as shown below:

Column 4, line 12, in claim 1, after “surface;” delete -- and --.

Signed and Sealed this

Twentieth Day of January, 2009

JON W. DUDAS
*Director of the United States Patent and Trademark Office*